US006328852B1

(12) United States Patent
McGary et al.

(10) Patent No.: US 6,328,852 B1
(45) Date of Patent: Dec. 11, 2001

(54) METHOD AND APPARATUS FOR IMPROVING STABILITY OF MOVING WEBS

(75) Inventors: Stephen Percival John McGary, Huntsville (CA); Scott A. Baum, Madison; Paul Douglas Beuther, Neenah, both of WI (US); Robert Paul Guarnotta, Evans, GA (US); Richard Martin Urquhart, Broken Arrow, OK (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/615,150

(22) Filed: Jul. 13, 2000

Related U.S. Application Data

(60) Provisional application No. 60/150,442, filed on Aug. 24, 1999.

(51) Int. Cl.[7] ..... D21F 1/36; B65H 20/14

(52) U.S. Cl. ..... 162/199; 162/272; 162/280; 162/283; 162/363; 34/116; 34/114; 34/120; 226/97.3; 226/7

(58) Field of Search ..... 162/193, 197, 162/198, 199, 272, 263, 273, 275, 283, 280, 281, 111, 363; 34/114, 117, 116, 120, 122, 628, 623, 629, 641, 650, 651; 242/147 A, 147 R, 520, 542.3, 615.4; 226/7, 91, 97.3

(56) References Cited

U.S. PATENT DOCUMENTS

| | | | | |
|---|---|---|---|---|
| 3,585,783 | | 6/1971 | Fleissner . | |
| 3,650,043 | | 3/1972 | Overly et al. . | |
| 4,330,356 | | 5/1982 | Grollimund et al. . | |
| 4,502,231 | | 3/1985 | Fissmann et al. . | |
| 4,628,618 | * | 12/1986 | Virta et al. | 34/116 |
| 4,686,777 | * | 8/1987 | Cooke | 34/116 |
| 4,716,660 | | 1/1988 | Thiele . | |
| 4,726,532 | | 2/1988 | Holm . | |
| 4,821,429 | | 4/1989 | Sieberth . | |
| 4,881,327 | | 11/1989 | Hauser et al. . | |
| 4,906,333 | | 3/1990 | Myren . | |
| 5,325,608 | * | 7/1994 | Mayer | 34/114 |
| 5,337,968 | | 8/1994 | De Bin et al. . | |
| 5,557,863 | * | 9/1996 | Kokkala | 34/629 |
| 5,720,852 | * | 2/1998 | Virta et al. | 162/193 |
| 5,888,349 | * | 3/1999 | Lau et al. | 162/199 |
| 5,967,457 | * | 10/1999 | Wildenberg et al. | 242/615.4 |
| 5,970,627 | * | 10/1999 | Stenz et al. | 34/633 |
| 6,039,842 | * | 3/2000 | Lau et al. | 162/272 |
| 6,068,735 | | 5/2000 | Marchal . | |

FOREIGN PATENT DOCUMENTS

| | | |
|---|---|---|
| 3731541 A1 | 3/1988 | (DE) . |
| WO 98/03418 A1 | 1/1998 | (WO) . |
| WO 98/33976 A1 | 8/1998 | (WO) . |

OTHER PUBLICATIONS

Abbott, E. C. "Creping Doctor Technology—Today and Tomorrow", 1990 Tappi Tissue Seminar, 4 pages.

* cited by examiner

*Primary Examiner*—Jose Fortuna
(74) *Attorney, Agent, or Firm*—Gregory E. Croft

(57) ABSTRACT

In manufacturing a moving web, such as a tissue sheet, the web is transported at very high speeds, often in an unsupported manner, which can result in unstable operations regarding handling and winding of the web. This is particularly true in the region between the creeping blade and the reel for a lightweight, low modulus tissue sheet that is characteristic of a high-quality, soft tissue base sheet. To provide an improved means of controlling the tissue web during manufacture and to improve the manufacturing rate, an apparatus and method of stabilizing the moving web that incorporates a creeping blade foil, one or more aerodynamic sheet stabilizing foils, and a roll foil in a specific relationship to each other is disclosed. This method has been shown to improve the stability of a moving tissue web, allow for a higher rate of operation, and enable the production of softer tissue basesheets.

41 Claims, 5 Drawing Sheets

METHOD AND APPARATUS FOR IMPROVING STABILITY OF MOVING WEBS

This application claims benefits of Ser. No. 60/150,442 filed on Aug. 24, 1999.

BACKGROUND OF THE INVENTION

In manufacturing a moving web, such as a tissue sheet, it is desirable to produce a base sheet that is soft. Similarly, it is desirable to manufacture the web at as high a rate possible to minimize manufacturing cost. Unfortunately, a moving web such as a tissue sheet becomes unstable when transported at high rates of speed unless undue tension is applied to the web. For a low modulus tissue web it is not possible to apply a level of tension to completely stabilize the high-speed moving web without pulling out the crepe reducing softness. Therefore, there is a desire and need by manufacturers to improve the methods of transporting a low tension web, such as a tissue web, at a high rate of speed while still maintaining sheet stability and avoiding product damage.

SUMMARY OF THE INVENTION

It has now been discovered that high speed tissue webs can be stabilized within the dry end of a tissue machine by the proper placement and use of two or more sheet handling elements, namely a creeping blade foil, an airfoil and a roll foil. Stabilization of the web can permit the speed of the paper machine to be increased. Alternatively, the associated waste and delay of the paper machine can be reduced if the machine is already speed limited. While the entire system is directed towards stabbing a tissue web in a paper machine, the system's elements can be used to stabilize any moving web in any web processing machine.

As used herein, an "airfoil" is a substantially web wide sheet handling element intended to stabilize a moving web. An airfoil may be active in that it might use compressed air or vacuum to enhance or augment the airfoil's natural ability to stabilize the moving web. An airfoil also may be passive and rely solely on the web's movement to attract the web to the airfoil. A few examples of airfoils, and by no means exclusive, include a simple flat plate, a common oval shaped airfoil having two flat parallel surfaces with rounded leading and trailing ends, and the airfoil shown in FIG. 3.

A "first location" means any point in space the moving web occupies prior to a rotating roll in a web handling process.

A "second location" means any point in space the moving web occupies after being creed off the surface of a rotating roll or a Yankee dryer.

A "rotating roll" means a circular roll, rotating about its axis and includes, but is not limited to, a reel drum, a winder drum, a Yankee dryer, a guide roll, and an idler roll.

Hence in one aspect, the invention resides in a method for transferring a moving web from a first location to a rotating roll comprising: (a) stabilizing the moving web on an airfoil located between the first location and a roll foil; (b) directing the moving web toward the roll foil having an internal volume, a back surface, and a gap in the back surface in fluid communication with the internal volume and connected to a source of vacuum; the placement of the roll foil defining a region bounded by the rotating roll on a first side, the back surface on a second side, and the web on a third side; and (c) extracting from the region through the gap at least a portion of the boundary layer air traveling with the rotating roll.

In another aspect, the invention resides in a method for transferring a moving web from a creeping blade in a creeping blade holder to a second location comprising: (a) stabilizing the moving web on a creeping blade foil located beneath the moving web having a top surface with a front edge and a back edge, the front edge touching or in close proximity to either the creeping blade or the creeping blade holder; (b) directing the moving web towards one or more airfoils located between the creeping blade foil and the second location, at least one airfoil having a bottom, a top, a nose, and a tail, the bottom being essentially flat, the nose being a curved surface attached to the bottom and the top, the top being another curved surface extending from the nose to the tail meeting with the bottom at an edge; and (c) stabilizing the moving web on the airfoils.

In another aspect, the invention resides in a method for transferring a moving web from a creeping blade in a creeping blade holder to a rotating roll comprising: (a) stabilizing the moving web on a creeping blade foil having a top surface, a front edge, and a back edge, the creeping blade foil being located beneath the moving web with the front edge touching or in close proximity to the creeping blade or the creeping blade holder; (b) stabilizing the moving web on at least one airfoil located between the creeping blade foil and a roll foil, the roll foil having an internal volume, a back surface, and a gap in the back surface in fluid communication with the internal volume connected to a source of vacuum; the placement of the roll foil defining a region bounded by the rotating roll on a first side, the back surface on a second side, and the web on a third side; and (c) extracting from the region into the internal volume of the roll foil by vacuum through the gap at least a portion of the boundary layer air traveling with the rotating roll whereby the moving web is transferred to the rotating roll with minimal disturbance.

In another aspect, the invention resides in an apparatus for transferring a moving web to a rotating roll comprising: (a) a roll foil having an internal volume, a front surface, a back surface, and a top surface, the placement of the roll foil defining a region bounded by the rotating roll on a first side, the back surface on a second side, and the web on a third side; (b) a boundary layer reduction member attached to the roll foil adapted to reducing the boundary layer of air traveling with the rotating roll; and (c) a gap in the back surface in fluid communication with the internal volume of the roll foil connected to a source of vacuum.

In yet an additional aspect, the invention resides in an apparatus for transferring a moving web to a rotating roll comprising: (a) a roll foil located adjacent a rotating roll having an internal volume, a front surface, and a back surface; (b) a gap in the back surface in fluid communication with the internal volume and connected to a source of vacuum adapted to removing at least a portion of the boundary layer of air traveling with the rotating roll; and (c) a boundary layer reduction member attached to the back surface.

In one preferred embodiment, a creeping blade foil having a front edge, a back edge, and a top surface is placed immediately following the creeping blade touching the creeping blade holder. The tissue web, after creeping, then runs adjacent to the creeping blade foil's top surface and leaves the foil parallel to the top surface at the foil's back edge. The creeping blade foil stabilizes the tissue web, after the instability of the creeping process, and directs the web to a second location. Between the second location and the creeping blade foil, at least one other airfoil is placed adjacent to the web.

In another preferred embodiment, a roll foil is provided to smoothly transfer the moving web to a rotating roll, such as a reel drum. The roll foil includes a top surface, a back surface, a front surface, and has an internal volume connected to a source of vacuum. In operation, the roll foil is placed near the rotating roll. Preferably, the back surface is arcuate and matches the radius of the rotating roll such that the roll foil can be placed immediately adjacent the rotating roll to minimize the distance between the roll foil and the roll's surface. The roll foil is placed such that the web runs adjacent to the top surface, and then the web is transferred to the rotating roll's surface. The transfer of the web in this manner defines a region or pocket bounded on one side by the rotating roll, on a second side by the roll foil and on a third side by the tissue web. A gap, located in the back surface of the roll foil, is in fluid communication with the roll foil's internal volume. A source of vacuum then draws air though the gap into the roll foil. This eliminates at least a portion of the boundary layer air traveling with the rotating roll, promoting a smooth transfer of the web to the rotating roll's surface. Alternatively, the vacuum can be adjusted to provide a negative air pressure in the region pulling the tissue web onto the rotating roll's surface.

Without a roll foil the tissue web tends to billow away from the rotating roll's surface due to boundary layer air traveling with the surface of the rotating roll. If the roll is a reel drum wrinkles can be wound into the product from the billowing. Furthermore, such billowing severely reduces the efficiency of the automatic turn-up sequence for a paper machine reel. The roll foil also serves to reduce machine-direction tension variations of the moving tissue web. Web stability is improved if the web tension is constant and not varying thereby reducing web flutter upstream of the roll foil.

In order to eliminate some of the boundary layer air traveling with the rotating roll a boundary layer reduction member, such as a wiper, is attached to the roll foil's back surface and is in contact or close proximity to the rotating roll's surface. The wiper has been found an integral part of the system because it prevents the accumulation of dust and debris from entering the space between the roll foil and the rotating roll. Furthermore, the wiper reduces the amount of airflow required though the gap to prevent billowing by initially blocking a portion of the boundary layer air traveling with the rotating roll. The boundary layer reduction member could be a simple rubber flap or a more complicated doctor blade.

An alternative boundary layer reduction member is an air shower. This is desirable for applications involving a rough coated roll surface such as plasma coating. It is not as practical to use a wiper or doctor blade as a boundary layer reduction member on such a surface since the contact could wear the surface and the wiper. The air shower works by creating a low-pressure area upstream of the airflow entwining additional air. Because the air shower is directed to oppose the rotation of the rotating roll, it strips off part of the boundary layer air traveling with the rotating roll, and entrails upstream air from the region helping reduce the air pressure in the region. The air shower is also useful to clean the rotating roll's surface, and to prevent debris during a web break from entering the region or the gap.

In operation, a moving web located at a first location traverses a span to the roll foil and is transferred to the rotating roll. The roll foil eliminates at least a portion of the boundary layer air traveling with the rotating roll reducing or eliminating billowing of the web at the point of transfer to the roll. Between the first location and the roll foil, at least one other airfoil is located to stabilize and direct the web to run adjacent to the roll foil's top surface.

In the most preferred embodiment, all three sheet handling elements are utilized. The moving web is initially stabilized by the creeping blade foil, further stabilized and directed by a plurality of airfoils, and then finally transferred to the rotating reel drum's surface by the roll foil. It has been found that only using the creeping blade foil and at least one other airfoil to stabilize the initial portion of the web run enhances sheet handling. Similarly, using only the roll foil and at least one other airfoil is effective to stabilize only the final portion of the web run. These alternatives are considered part of the claimed invention, along with use of all three sheet handling elements.

DETAILED DESCRIPTION OF THE DRAWINGS

Figure 1:
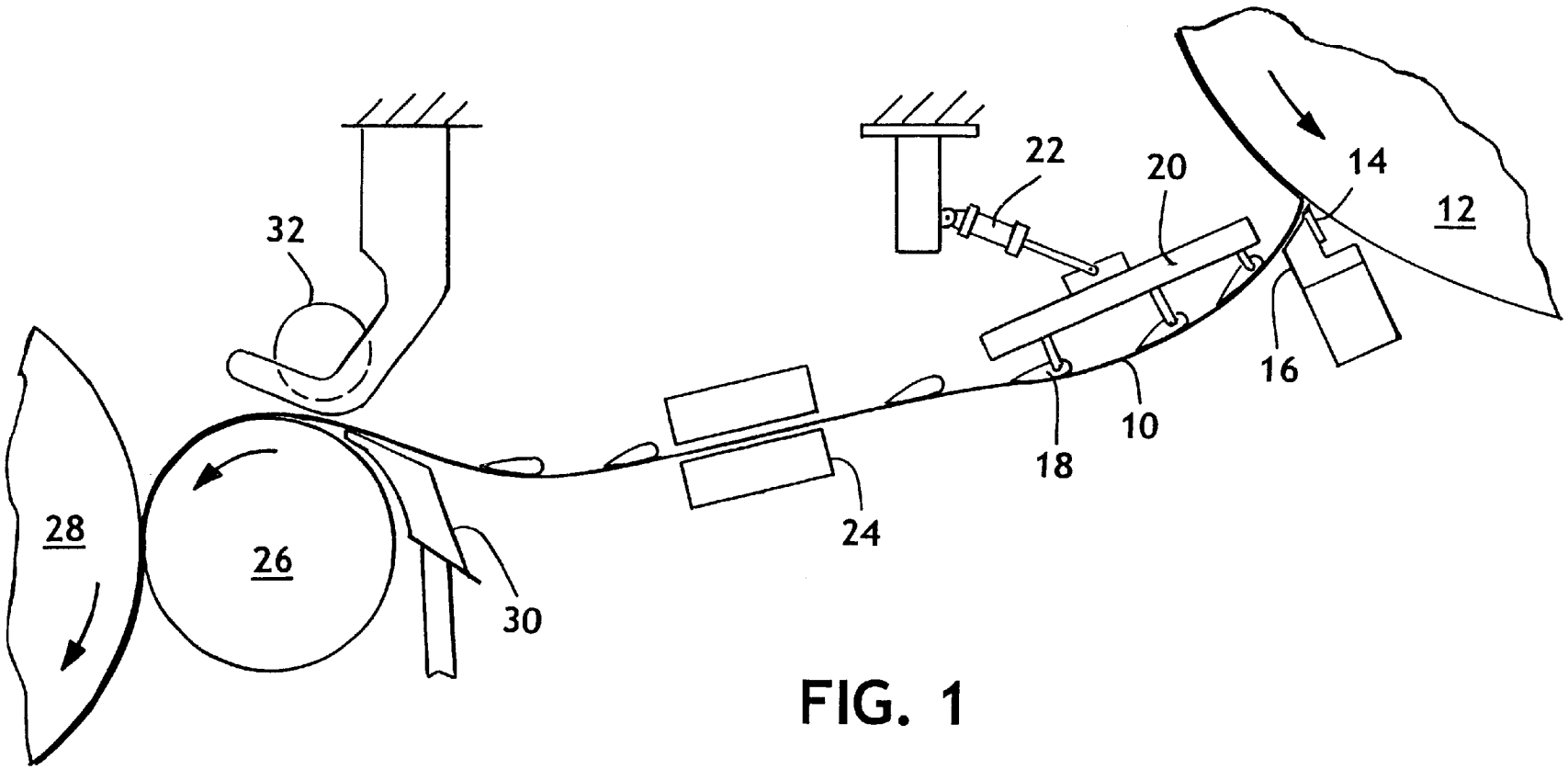
FIG. 1 is an elevation-view of the dry-end of a paper machine utilizing an improved sheet handling method of this invention.

The invention will now be described in greater detail with reference to the figures where similar elements in different figures have been given the same reference numeral. FIG. 1 illustrates the dry-end of a paper machine utilizing the improved sheet handling method in an application to stabilize a creed tissue web. A tissue web 10 is adhered to the surface of a Yankee dryer 12. The tissue web impacts a creeping blade 14, and it is softened by the mechanical action of the creeping blade. The tissue web then travels adjacent to a creeping blade foil 16. The creeping blade foil stabilizes the moving tissue web removing the instabilities introduced by the creeping process.

The creeping blade foil also directs the tissue web towards a plurality of airfoils 18. It has been discovered that using several short machine-direction airfoils provides superior sheet handling capabilities as opposed to fewer larger airfoils. The airfoils may be attached to a retractable frame 20 in order to provide improved operator access to the creeping blade when performing a blade change. A pair of hydraulic cylinders 22 accomplishes retraction of the frame and airfoils.

The tissue web leaves the front portion of the dry-end of the paper machine, and then travels past a scanner 24. The scanner is an integral part of the process control system on most paper machines. It is important to locate an airfoil immediately prior to and following the scanner. A flat stable moving tissue web in the scanner region is necessary to reduce web breaks, and to obtain accurate process information from the scanner. The tissue web continues from the scanner past additional airfoils to the surface of a reel drum 26. The tissue web travels with the surface of the reel drum, and then it is wound onto a softroll 28.

A roll foil 30 is located adjacent the reel drum. The roll foil's primary function is to remove the boundary layer of air traveling with the rotating drum. This air, when uncontrolled, causes billowing of the tissue web because the boundary layer air must either be forced through the tissue web or out past the edges of the web as the web transfers to the drum's surface. Uncontrolled boundary layer air, between the drum and the tissue web, can cause web-tracking problems wherein the tissue web skates in an uncontrolled manner on the drum surface. This can cause wrinkles and fold-overs to be wound into the softroll, which causes associated waste and delay in following processing operations.

The billowing also severely impacts the automated turn-up sequence of the reel as a reel spool 32 is lowered into the staging position. The web can billow to such an extent that it touches the surface of the reel spool. In addition, the spinning of the empty reel spool, necessary to perform a turn-up, creates sufficient windage to pull the tissue web off the drum surface especially if a thick boundary layer of air is present between the tissue web and the drum surface. The billowing can cause the web to prematurely wrap the empty reel spool or cause an immediate web break as soon as the reel spool touches the drum's surface. The inventor's have discovered a roll foil eliminates all of the aforementioned problems.

Figure 2:
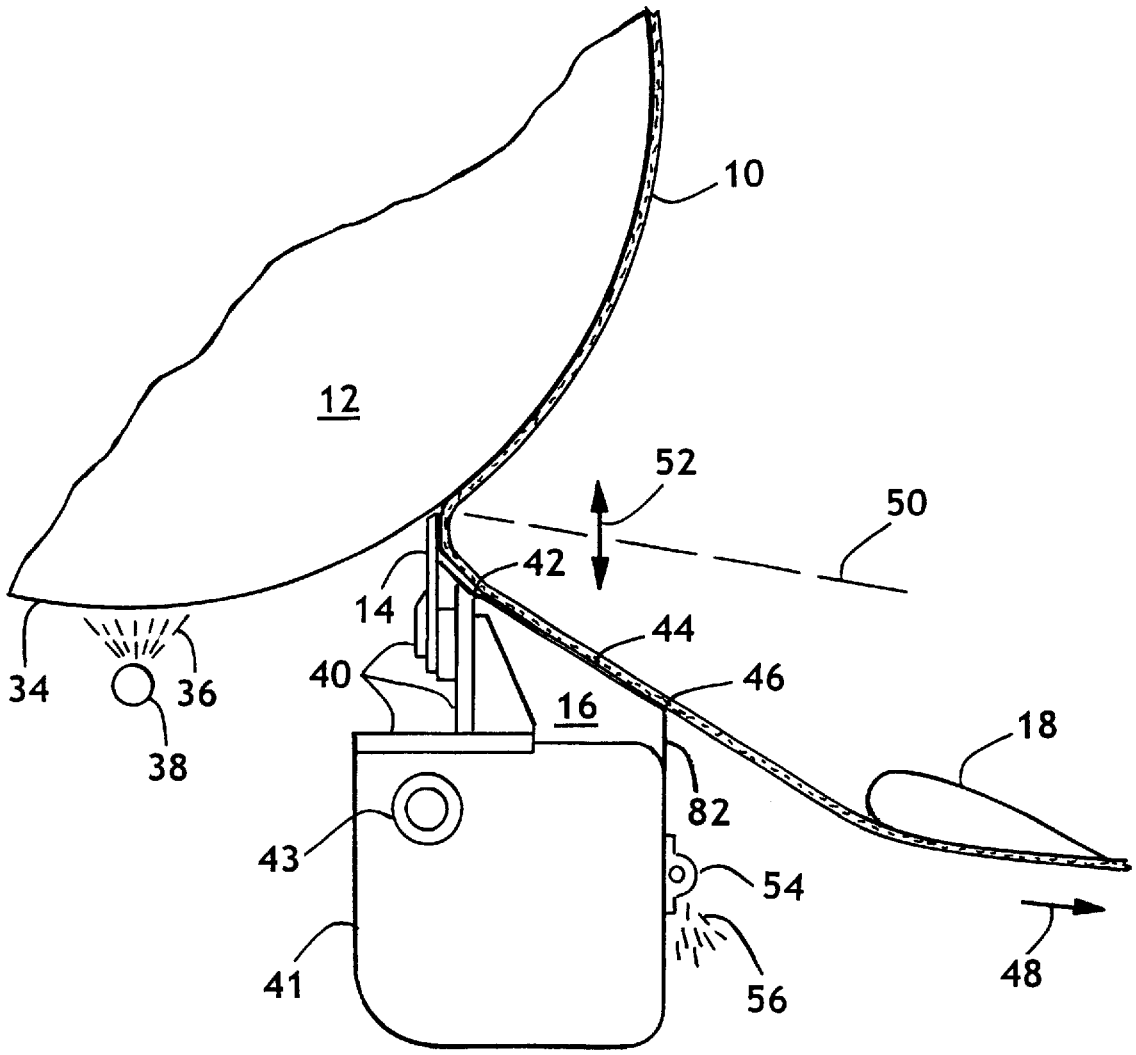
FIG. 2 is an elevation-view of the creeping blade foil shown in FIG. 1.

Referring now to FIG. 2 the function and design of the creeping blade foil will be described in more detail. The tissue web 10 is adhered to a Yankee dryer surface 34 of a Yankee dryer 12. This is accomplished by the application of creeping chemicals 36 via a spray boom 38. The adhered tissue web impacts a creeping blade 14 that is held in a creeping blade holder 40. The creeping blade holder in combination with other support elements loads the creeping blade firmly against the surface of the Yankee dryer. The creeping blade holder is attached to a beam 41. The beam is rotatable about a pair of pivots 43. Loading and retraction of the creeping blade, against the Yankee dryer surface, is accomplished by a pair of hydraulic cylinders (not shown). A creeping blade foil 16 is located such that a front edge 42 touches the creeping blade holder. As shown the tissue web, after creeping, runs adjacent to a top surface 44 of the creeping blade foil. The tissue web travels along the top surface and leaves the creeping blade foil at a back edge 46 parallel to the top surface.

The tissue web continues traveling in the direction of a second location 48, and it may be stabilized by use of a subsequent airfoil. Preferably, as shown, the airfoil's bottom surface, where it joins the nose, is located tangent to the creeping blade foil's top surface such that the airfoil's nose is located past the creeping blade foil's back edge in the direction of web travel. Such an airfoil orientation will leave a slight gap between the airfoil's nose and the creeping blade foil's rear edge. The gap is preferably from about 4 to about 12 inches. The orientation will allow the tissue web to wrap the nose of the airfoil before being directed to the bottom surface without lifting the tissue off the creeping blade foil's back edge. The orientation will also prevent dragging the tissue web over the creeping blade foil's rear edge minimizing dust while maximizing tissue softness.

Surprisingly the inventor's have found that not only is tissue stability increased, but also the softness and quality of the creed tissue web can be increased when a creeping blade foil is used. References such as the article *Creeping Doctor Technology* by E. C. Abbot and James Ross, published in the 1990 TAPPI Tissue Seminar Conference Notes teach the need to prevent the tissue web from dragging across the doctor blade heel as shown in FIG. 1 of the article. The reference shows a pass line 50 is required to ensure tissue quality is not degraded by dragging the tissue over the creeping blade's heel after impacting the blade's front edge. However, the unsupported tissue when assuming the ideal pass line, flutters in the direction indicated by an arrow 52. This introduces further instabilities into the creeping process resulting in a non-uniform creed tissue web. Use of a creeping blade foil reduces or eliminates tissue web flutter resulting in an improved creeping process.

If desired, a knockdown air shower 54 can be used to help convey and clear the tissue web from the creeping area in case of a web break and during blade changes. The air shower can be located on the beam and is connected to a source of compressed gas. The resulting air stream 56 is adjusted to pull the tissue web away from the creeping area. When the air shower is in use, the tissue web runs adjacent top surface 44, is pulled along a back surface 82 of the creeping blade foil, and is directed towards the machine room floor, an under-machine pulper, or a conveyor belt (not shown).

It is possible to locate the creeping blade foil in positions higher or lower than the one shown in FIG. 2. For instance top surface 44 can be located closer to the ideal pass line 50 by raising the entire top surface toward the ideal pass line, while simultaneously moving front edge 42 closer to the creeping blade or the creeping blade holder. It is not necessary that front edge 42 touch the creeping blade or the creeping blade holder, and having front edge 42 in close proximity to either element has been found to stabilize the web. The location shown in FIG. 2 is presently preferred, and the location improves operator access when changing a creeping blade. In addition, having front edge 42 of the creeping blade foil touch the creeping blade holder eliminates the possibility of moving tissue web 10 from getting stuck in a gap between the creeping blade foil and the creeping blade holder during a web break.

Figure 3:
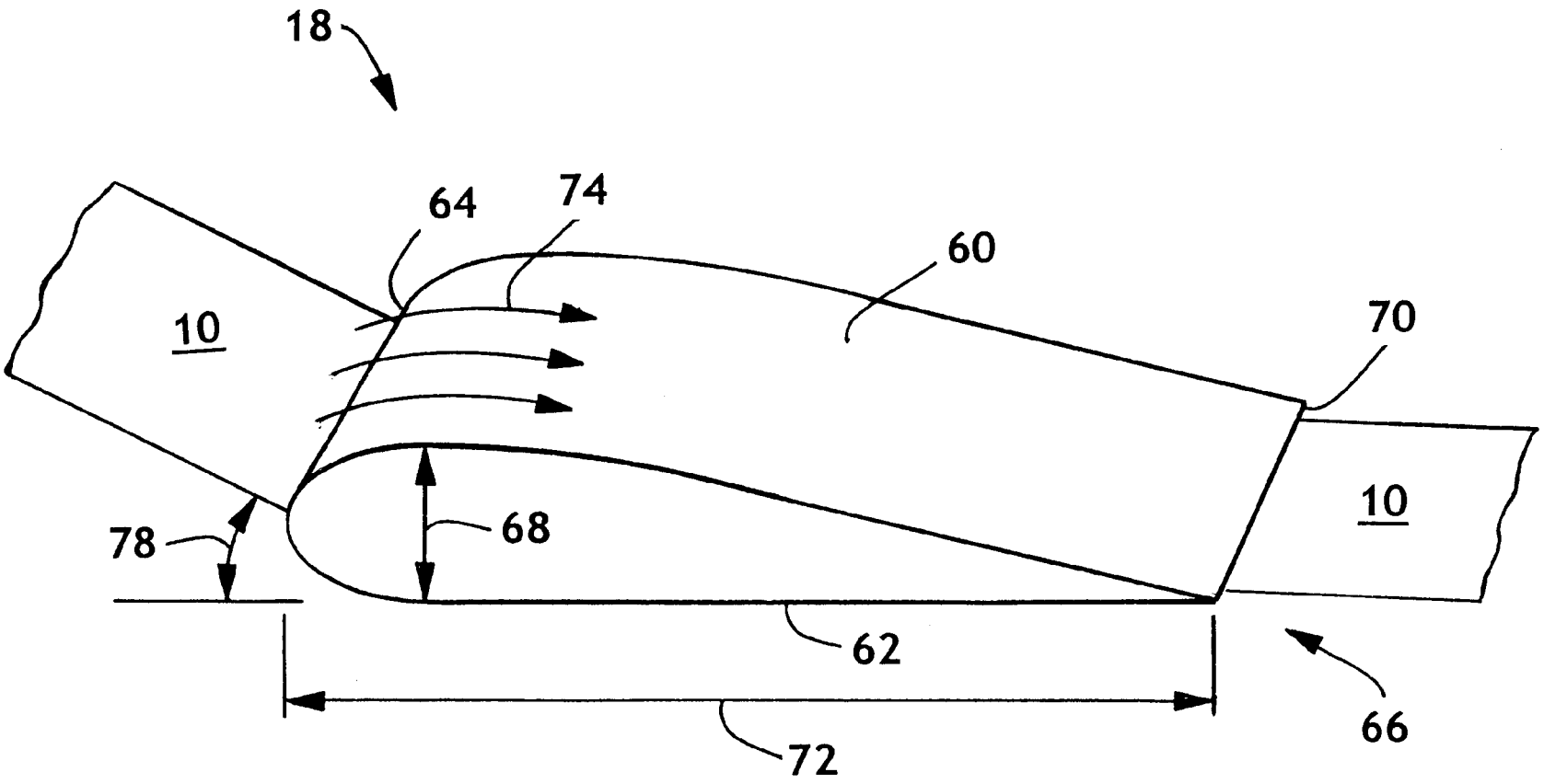
FIG. 3 is a perspective view of the airfoil shown in FIG. 1.

Referring now to FIG. 3, an airfoil 18 used to stabilize the moving tissue web 10 in a paper machine is shown. The airfoil includes a top 60, a bottom 62, a nose 64, and a tail 66. The bottom of the airfoil is essentially flat and planar. The nose of the airfoil is a curved surface and is attached to the bottom and the top at a transition near arrow 68. The nose has a thickness 68. The thickness of the nose is from about 0.5 inches to about 6 inches and is preferably 1 inch. The top surface is another curved surface connecting smoothly with the nose and meeting with the bottom surface at the tail in an edge 70. Such a design results in a tapered airfoil as shown. The length of the airfoil is from about 2 to about 24 inches and is preferably from about 10 to about 12 inches in length. Experimental studies have shown that web stability is increased, as the length of the airfoil is increased, until the airfoil reaches approximately 12 inches in length. Further increases in length provide no additional sheet handling capability, and the increasing length can actually degrade sheet handling if the length becomes too great. This is due to boundary layer air traveling with the tissue web that bleeds though the porous tissue web accumulating between the tissue web and the airfoil's bottom. Because the airfoil no longer effectively stabilizes the web, the tissue web moves away from the airfoil's surface riding on a layer of air. Such movement can lead to wrinkles, fold-overs at the edges, and web tracking problems. Thus, using several shorter airfoils in a given span, as opposed to one longer continuous airfoil, can improve the sheet handling of the tissue web in that span. Optionally, one or more of the airfoils can be bowed in the cross-machine direction to spread the web if localized wrinkling is present.

It is important to design the airfoil with a thin nose section. This allows the boundary layer air, traveling with the tissue web, to separate cleanly from the web and be directed over the airfoil's top surface as indicated by the arrows 74. To ensure proper boundary layer air separation, the tissue web wraps the nose of the airfoil as indicated by a wrap angle 78. The wrap angle is about 1 to about 30 degrees and is preferably 5 to 10 degrees. Such a wrap angle provides clean separation of the boundary layer air while minimizing the drag associated with larger wrap angles.

Figure 4:
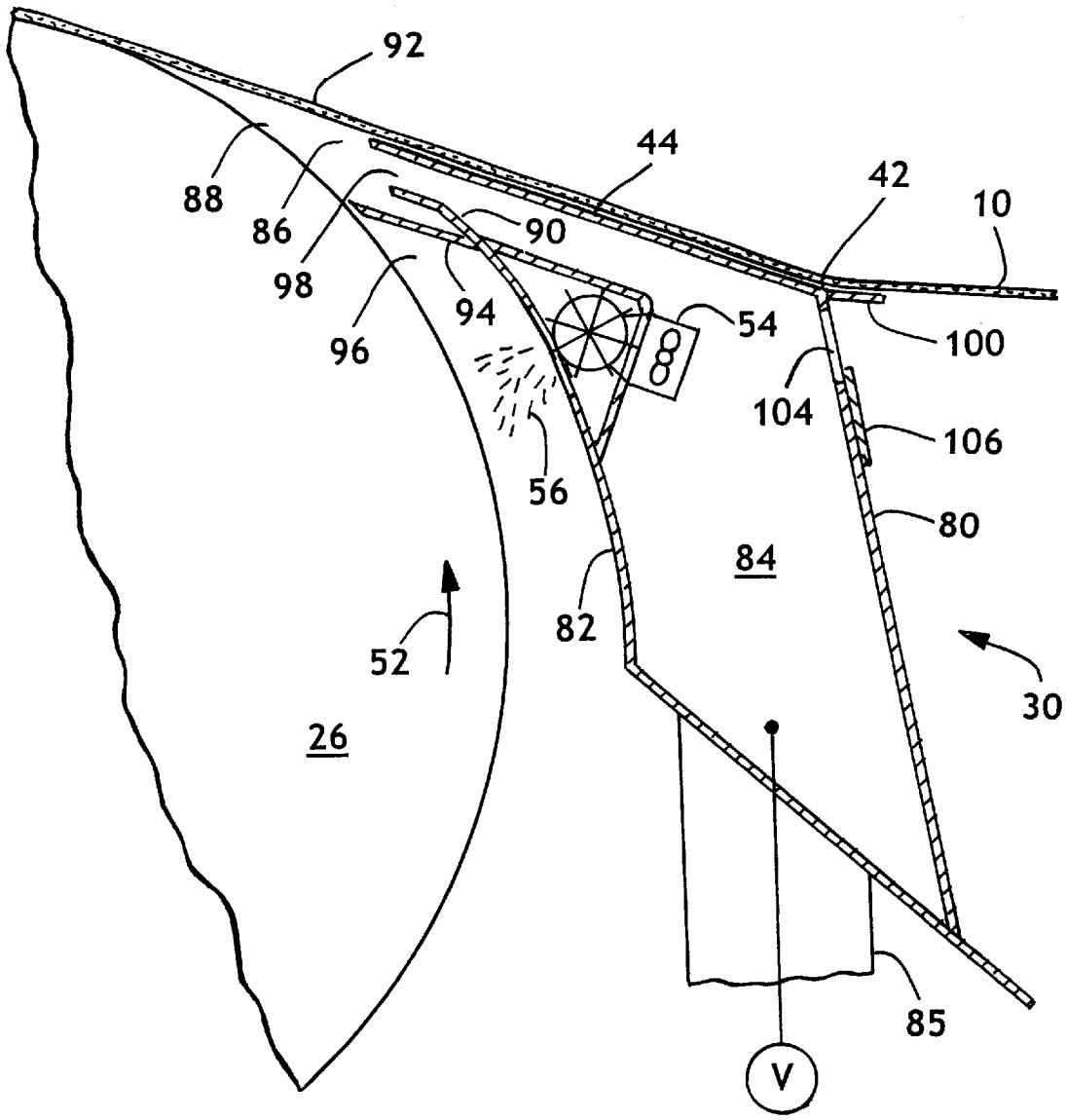
FIG. 4 is an elevation-view of a cross-section of the roll foil shown in FIG. 1.

Referring now to FIG. 4, a cross-section of a roll foil 30 is shown in detail. The roll foil has a top surface 44, a front surface 80, a back surface 82, and an internal volume 84. The internal volume is connected to a source of vacuum by a duct 85 as indicated by the circle with the letter "V". The moving tissue web 10 runs adjacent to the top surface prior to being transferred to the rotating reel drum 26. The reel drum is rotating in a direction illustrated by an arrow 52. A region 86 is thereby created bounded on a first side 88 by the rotating reel drum, on a second side 90 by the back surface of the roll foil, and on a third side 92, by the tissue web. A boundary layer reduction member, in this case a wiper 94 constructed of a flexible material, is attached to the back surface of the roll foil and contacts the surface of the reel drum defining a fourth side 96 to the region. Alternatively, instead of a wiper, a doctor blade can be used. A gap 98 is located in the back surface of the roll foil. The gap is in fluid communication with the interior volume such that the source of vacuum supplied to the roll foil is able to evacuate air from the region.

In operation, the tissue web is stabilized by the top surface of the roll foil. If desired, for better performance, an optional deflector 100 can be located on the front edge 42 of the roll foil. The deflector protrudes at a shallow angle into the tangent line of the web path. Thus, one side of the tissue web contacts the deflector and removes a portion of the boundary layer air traveling with the web, enhancing the web's stability on the top surface. The web travels from the top surface to the reel drum traversing the previously described region. Boundary layer air traveling with the rotating reel drum is initially reduced, but not completely eliminated by the wiper. Some or all of the remaining boundary layer air, which might be drawn into the region from the sides, is evacuated though the gap by the supplied vacuum.

Evacuating air from the region creates a positive transfer of the tissue web to the reel drum by literally pulling the tissue web onto the drum's surface. By increasing the level of vacuum, it is possible to draw air though the porous tissue web on the region's third side creating an extremely positive transfer of the web to the reel drum's surface. In this mode of operation the region is at a slightly negative air pressure from ambient. This is evidenced in operation by a slight depression or belly in the tissue web after leaving the roll foil's top surface prior to contacting the reel drum's surface. A smooth boundary layer free transfer of the tissue web to the reel drum increases the web stability well upstream of the roll foil. Furthermore, softroll wrinkles are eliminated and turn-up efficiency is greatly increased.

Mounted to the roll foil is an optional air shower 54 that directs an air stream 56 onto the reel drum's surface, preferably blowing against the rotating roll in a direction opposite to the rotation. This cleans the drum's surface of loose dust and debris and prevents any debris from accumulating between the roll foil and the reel drum. The air shower can be in the form of a drilled pipe or a coanda effect nozzle such as an airknife manufactured by Exair Corporation, 1250 Century Circle N, Cincinnati, Ohio 45246.

It is possible to use only the air shower and eliminate wiper 94 if desired. In this mode of operation the air shower becomes the boundary layer reduction member defining the fourth side 96 of region 86. This mode of operation is preferred for rough textured rolls where the use of a wiper or doctor blade is impractical. The air shower or coanda effect nozzle works by creating a low-pressure area upstream of the nozzle's output airflow. Thus, air is entrained from the region 86 and combined with the compressed airflow from the air shower, and directed against the boundary layer air traveling with the rotating roll. This tends to strip away a portion of the boundary layer air traveling with the rotating roll. The wiper combined with the air shower is the presently preferred mode; the wiper is more effective at reducing boundary layer air, and the air shower is effective to clean the roll's surface while preventing debris from entering the space between the roll foil's back surface and the rotating roll.

While one specific configuration has been shown, alternative configurations are possible and within the scope of the claimed invention. For instance the wiper 94 can be placed at any position along the back surface 82 and would not need to touch the drum's surface. The gap 98 can be located anywhere along back surface 82. The back surface could be changed from the arcuate one shown, although this is preferred to position the roll foil as close as possible to reel drum.

Figure 5:
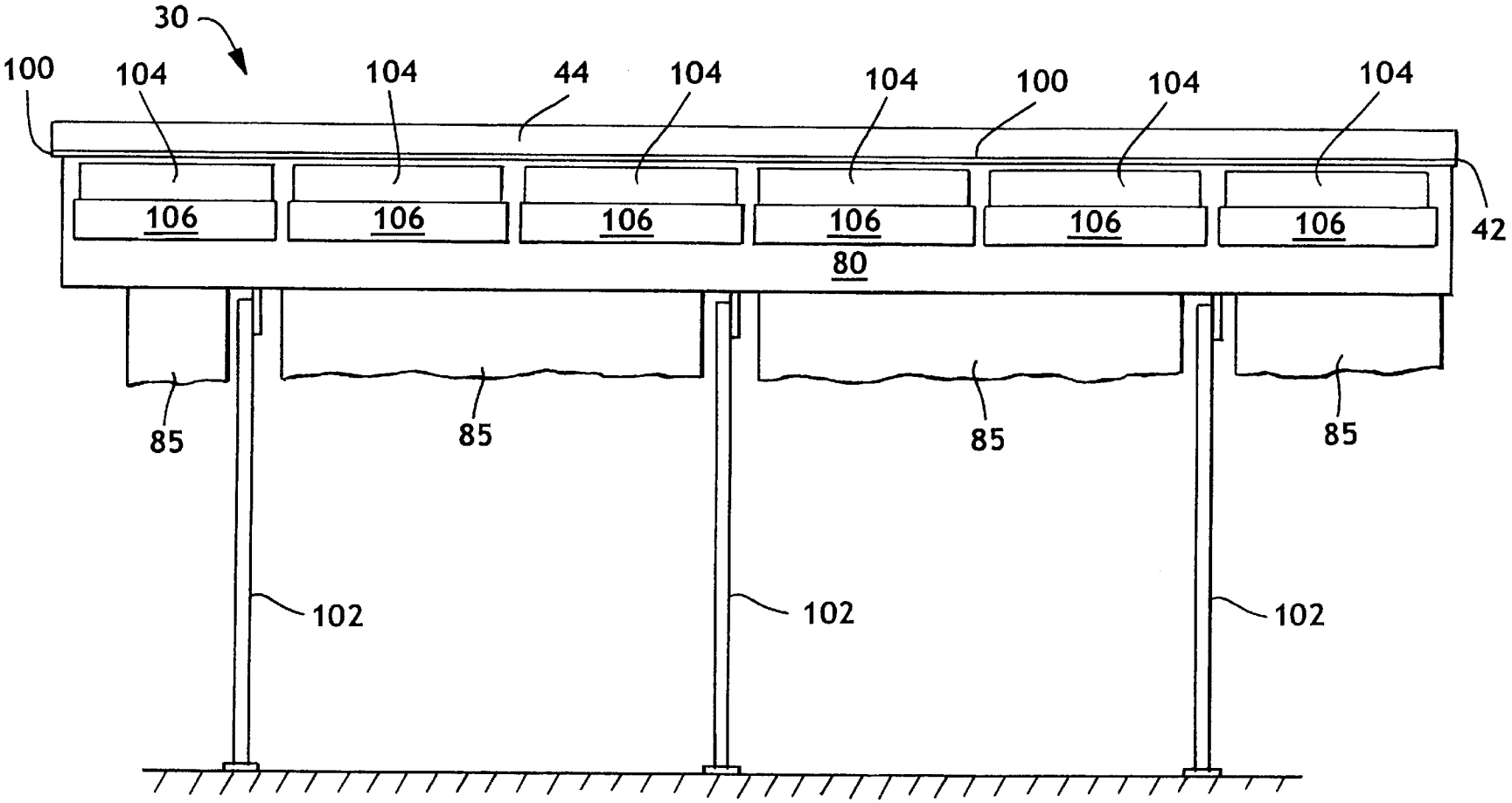
FIG. 5 is a machine-view of the roll foil shown in FIG. 1.

Referring now to FIG. 5, the roll foil 30 is shown in a machine direction view. The roll foil is supported by a plurality of legs 102 to locate the foil in proper relation to the reel drum (not shown). Located in the front surface 80 is a plurality of openings 104. The openings are in fluid communication with the interior volume of the roll foil such that air can be drawn through the openings, into the interior volume 84, and be exhausted by a duct 85. While a plurality of openings is shown, a single opening can be used. Preferably, at least a portion of each opening is located within the thickness of the boundary layer of air traveling with the web. This is accomplished by locating the openings close to a front edge 42 of the top surface. The size of the openings can be adjusted by a plurality of cover plates 106. The cover plates are designed such that the openings may be completely closed.

In operation, boundary layer air traveling with the moving tissue web removed by the deflector 100 travels down the front surface 80 of the roll foil and is removed by airflow entering the openings from the vacuum supplied by duct 85. This prevents a build up of positive pressure on the roll foil's front surface that could push the tissue web away from the top surface 44. Additionally, the openings are an effective means of reducing dust in the dry-end of the tissue machine. Boundary layer air traveling with the moving tissue web is laden with small fibers and dust from the creeping operation. By collecting the boundary layer air, this dust can be sent to a dust removal system reducing environmental dust in the machine room.

The openings also provide a means to control the amount of air entering the gap on the roll foil's back surface. Control of the air volume entering the gap is used to adjust the tissue web transfer to the reel drum. By changing the cover plates to reduce the size of the openings a more positive transfer occurs by drawing more air through the gap instead of the openings. This tends to reduce the air pressure in region 86. If a less positive transfer is desired, the size of the openings can be increased creating the opposite effect. Alternatively, the level of vacuum supplied by duct 85 can be changed instead of adjusting the openings, or utilized when front surface 80 does not contain any openings.

It will be appreciated that the foregoing detailed description, given for purposes of illustration, is not to be construed as limiting the scope of this invention, which is defined by the following claims and all equivalents thereto.

We claim:

1. A method for transferring a moving web from a first location to a rotating roll in a web processing machine comprising:

stabilizing the moving web on an airfoil located between the first location and a roll foil;

directing the moving web toward the roll foil, the roll foil having an internal volume, a back surface, and a gap in the back surface in fluid communication with the internal volume connected to a source of vacuum; the placement of the roll foil defining a region bounded by the rotating roll on a first side, the back surface on a second side, and the web on a third side; and extracting from the region into the internal volume of the roll foil by vacuum through the gap at least a portion of the boundary layer air traveling with the rotating roll.

2. The method of claim 1 wherein the roll foil has a planer top surface, and the airfoil directs the moving web to run adjacent to the top surface stabilizing the moving web on the roll foil prior to being transferred to the rotating roll.

3. The method of claim 2 wherein the roll foil has a deflector protruding partially into the moving web attached to the roll foil where the top surface meets a front surface, and the deflector reduces the amount of boundary layer air between the moving web and the top surface.

4. The method of claim 1 wherein a boundary layer reduction member is attached to the back surface defining a fourth side of the region, and the boundary layer reduction member reduces the amount of boundary layer air traveling with the rotating roll.

5. The method of claim 4 wherein the boundary layer reduction member comprises a wiper either touching the rotating roll or in close proximity to the rotating roll.

6. The method of claim 4 wherein the boundary reduction member comprises an air shower blowing against the rotating roll in a direction opposing the rotation.

7. The method of claim 6 wherein the air shower is a drilled pipe.

8. The method of claim 6 wherein the air shower is a coanda effect nozzle.

9. The method of claim 1 wherein the roll foil has at least one opening located in a front surface in fluid communication with the internal volume, and at least a portion of the boundary layer of air traveling with the moving web is extracted through the opening.

10. The method of claim 9 wherein at least a portion of the opening is located within the thickness of the boundary layer of air traveling with the moving web.

11. The method of claim 9 wherein the airflows entering the gap and the opening can be adjusted by a movable plate that changes the size of the opening.

12. The method of claim 1 wherein the region is at a pressure less than atmospheric pressure.

13. The method of claim 1 wherein the airfoil has a bottom, a top, a nose, and a tail; the bottom being essentially flat, the nose being a curved surface attached to the bottom and the top, the top being another curved surface extending from the nose to the tail meeting with the bottom at an edge.

14. The method of claim 1 wherein two or more airfoils are placed between the first location and the roll foil above the web, and the airfoils intermittently stabilize the moving web.

15. The method of claim 1 wherein the airfoil is bowed in the cross-machine direction spreading the web.

16. An apparatus for transferring a moving web from a first location to a rotating roll comprising:

a roll foil having an internal volume, a front surface, a back surface, and a top surface, the placement of the roll foil defining a region bounded by the rotating roll on a first side, the back surface on a second side, and the web on a third side;

a gap in the back surface in fluid communication with the internal volume of the roll foil connected to a source of vacuum; and an airfoil located between the first location and the roll foil whereby the airfoil directs the moving web onto the top surface of the roll foil, and the source of vacuum removes at least a portion of the boundary layer of air traveling with the rotating roll.

17. The apparatus of claim 16 wherein the back surface is arcuate.

18. The apparatus of claim 16 wherein the gap is located adjacent to the top surface.

19. The apparatus of claim 16 wherein the top surface is planer.

20. The apparatus of claim 16 wherein a boundary layer reduction member is attached to the roll foil and adapted to reducing some of the boundary layer of air traveling with the rotating roll.

21. The apparatus of claim 16 wherein the boundary layer reduction member comprises a wiper attached to the back surface either touching the rotating roll or in close proximity to the rotating roll.

22. The apparatus of claim 17 wherein the boundary layer reduction member comprises an air shower blowing against the rotating roll in a direction opposing the rotation.

23. The apparatus of claim 22 wherein the air shower comprises a drilled pipe.

24. The apparatus of claim 22 wherein the air shower comprises a coanda effect nozzle.

25. The apparatus of claim 16 wherein the roll foil has at least one opening located in the front surface in fluid communication with the internal volume.

26. The apparatus of claim 25 wherein at least a portion of the opening is located within the thickness of the boundary layer of air traveling with the moving web.

27. The apparatus of claim 25 wherein the opening has a plate that can be adjusted changing the size of the opening.

28. The apparatus of claim 16 wherein the roll foil has a deflector protruding partially into the moving web attached to the roll foil where the top surface meets the front surface.

29. An apparatus for transferring a moving web from a first location to a rotating roll comprising:

a roll foil located adjacent a rotating roll having an internal volume, a front surface, and a back surface;

a gap in the back surface in fluid communication with the internal volume and connected to a source of vacuum, the gap adapted to removing at least a portion of the boundary layer of air traveling with the rotating roll; and an airfoil located between the first location and the roll foil adapted to directing the moving web onto the roll foil.

30. The apparatus of claim 29 wherein the back surface is arcuate.

31. The apparatus of claim 29 wherein the roll foil has a top surface adapted to stabilizing the moving web.

32. The apparatus of claim 31 wherein the gap is located adjacent the top surface.

33. The apparatus of claim 29 wherein a boundary layer reduction member is attached to the back surface.

34. The apparatus of claim 33 wherein the boundary layer reduction member comprises a wiper either touching or in close proximity to the rotating roll.

35. The apparatus of claim 33 wherein the boundary layer reduction member comprises an air shower blowing against the rotating roll in a direction opposite to the rotation.

36. The apparatus of claim 35 wherein the air shower is a drilled pipe.

37. The apparatus of claim 35 wherein the air shower is a coanda effect nozzle.

38. The apparatus of claim 29 wherein the roll foil has at least one opening located in the front surface in fluid communication with the internal volume.

39. The apparatus of claim 38 wherein at least a portion of the opening is located within the thickness of the boundary layer of air traveling with the moving web.

40. The apparatus of claim 38 wherein the opening has a plate that can be adjusted changing the size of the opening adapted to regulate the amount of air moving through the opening.

41. The apparatus of claim 29 wherein the roll foil has a deflector protruding partially in to the web attached to the roll foil where the top surface meets the front surface.

* * * * *